US008925537B2

(12) United States Patent
Fan et al.

(10) Patent No.: US 8,925,537 B2
(45) **Date of Patent: *Jan. 6, 2015**

(54) TOY PROJECTILE LAUNCHER WITH SAFETY MECHANISM

(71) Applicant: Mattel, Inc., El Segundo, CA (US)

(72) Inventors: Peter Kit Chuen Fan, Torrance, CA (US); Fraser Paterson, Torrance, CA (US); Brandon Sopinsky, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/682,264

(22) Filed: Nov. 20, 2012

(65) Prior Publication Data

US 2013/0192575 A1 Aug. 1, 2013

Related U.S. Application Data

(63) Continuation of application No. 12/765,195, filed on Apr. 22, 2010, now Pat. No. 8,336,531.

(60) Provisional application No. 61/214,776, filed on Apr. 27, 2009.

(51) Int. Cl.

| | |
|---|---|
| ***F41B 11/00*** | (2013.01) |
| ***F41B 11/64*** | (2013.01) |
| ***A63H 33/00*** | (2006.01) |
| ***F41A 11/02*** | (2006.01) |
| ***F41B 11/643*** | (2013.01) |
| ***F41B 11/89*** | (2013.01) |

(52) U.S. Cl.

CPC ..... *F41B 11/64* (2013.01); *A63H 33/003* (2013.01); *F41A 11/02* (2013.01); *F41B 11/643* (2013.01); *F41B 11/89* (2013.01)

USPC ..... 124/65; 42/75.02; 42/75.04

(58) Field of Classification Search

CPC ..... F41B 11/00; F41B 11/89

USPC ..... 124/63–67, 55, 61; 42/75.01–75.04, 54, 42/55

See application file for complete search history.

(56) References Cited

U.S. PATENT DOCUMENTS

| | | | |
|---|---|---|---|
| 797,823 | A | 8/1905 | Seitz |
| 889,279 | A | 6/1908 | Warnant |
| 1,141,710 | A | 6/1915 | House |
| 1,144,739 | A | 6/1915 | Szlanyi |

(Continued)

FOREIGN PATENT DOCUMENTS

| | | | |
|---|---|---|---|
| EP | 367905 | B1 | 4/1992 |
| JP | 6023155 | A | 2/1994 |

OTHER PUBLICATIONS

International Search Report and Written Opinion for PCT/US10/032394, dated Dec. 28, 2010, 4 pages.

*Primary Examiner* — Michael David

(74) *Attorney, Agent, or Firm* — Edell, Shapiro & Finnan LLC

(57) ABSTRACT

A reconfigurable toy gun includes a handle portion, a guide member coupled to the handle portion, and a barrel portion. The barrel portion is slidably coupled to the guide member and movable along the guide member between a first end portion of the guide member and second end portion of the guide member.

20 Claims, 11 Drawing Sheets

(56) References Cited

U.S. PATENT DOCUMENTS

| | | | | | |
|---|---|---|---|---|---|
| 1,216,258 | A | | 2/1917 | Andersen | |
| 1,540,344 | A | | 6/1925 | Kohn | |
| 2,237,529 | A | | 4/1941 | Michaelson | |
| 2,708,537 | A | | 5/1955 | Dec | |
| 2,710,478 | A | | 6/1955 | Petersen | |
| 2,758,585 | A | | 8/1956 | Fields | |
| RE24,967 | E | | 4/1961 | Weimer | |
| 3,060,625 | A | | 10/1962 | Glass et al. | |
| 3,151,411 | A | | 10/1964 | Bonazza | |
| 3,262,440 | A | | 7/1966 | Kuhn | |
| 3,472,218 | A | | 10/1969 | La Mers | |
| 4,571,201 | A | * | 2/1986 | Matsuda | 446/85 |
| 4,598,491 | A | | 7/1986 | Noble | |
| 4,742,812 | A | * | 5/1988 | Goodman | 124/25 |
| 5,261,852 | A | | 11/1993 | Ejima | |
| 5,283,970 | A | | 2/1994 | Aigner | |
| 5,284,274 | A | * | 2/1994 | Lee et al. | 222/79 |
| 5,316,514 | A | | 5/1994 | Ellman et al. | |
| 5,351,427 | A | | 10/1994 | Aigner | |
| 5,377,656 | A | | 1/1995 | Lewinski et al. | |
| 5,381,928 | A | * | 1/1995 | Lee et al. | 222/79 |
| 5,564,964 | A | | 10/1996 | Chin-Chien | |
| 5,613,482 | A | | 3/1997 | Thai et al. | |
| 5,701,878 | A | * | 12/1997 | Moore et al. | 124/67 |
| 5,715,802 | A | | 2/1998 | Moore et al. | |
| 5,976,068 | A | | 11/1999 | Hakky et al. | |
| 6,119,671 | A | | 9/2000 | Smith et al. | |
| 6,151,824 | A | * | 11/2000 | Clayton | 42/54 |
| 6,250,294 | B1 | | 6/2001 | Lim | |
| 6,279,562 | B1 | * | 8/2001 | Clayton | 124/59 |
| RE37,616 | E | | 4/2002 | Schumacher | |
| 6,470,617 | B1 | | 10/2002 | Gregory et al. | |
| 6,523,535 | B2 | | 2/2003 | Rehkemper et al. | |
| 6,543,173 | B1 | | 4/2003 | Golan | |
| 6,868,846 | B2 | * | 3/2005 | Jzn | 124/74 |
| 7,185,787 | B2 | * | 3/2007 | Brown et al. | 222/79 |
| 7,267,118 | B2 | * | 9/2007 | Eddins et al. | 124/63 |
| 7,325,351 | B1 | | 2/2008 | Leung | |
| 7,481,209 | B1 | | 1/2009 | Bligh et al. | |
| 7,942,721 | B2 | * | 5/2011 | Wade | 446/473 |
| 2002/0134366 | A1 | * | 9/2002 | Rehkemper et al. | 124/78 |
| 2004/0226549 | A1 | * | 11/2004 | Jzn | 124/74 |
| 2005/0074277 | A1 | * | 4/2005 | Brown et al. | 403/79 |

* cited by examiner

TOY PROJECTILE LAUNCHER WITH SAFETY MECHANISM

CROSS REFERENCE TO RELATED APPLICATION AND CLAIM TO PRIORITY

This application is a continuation of prior U.S. Non-Provisional patent application Ser. No. 12/765,195, filed Apr. 22, 2010, which is based upon and claims priority under 35 U.S.C. 119(e) to U.S. Provisional Patent Application Ser. No. 61/214,776, filed Apr. 27, 2009. The disclosures of U.S. Provisional Patent Application Ser. No. 61/214,776 and U.S. Non-Provisional patent application Ser. No. 12/765,195 are incorporated herein by reference in their entirety for all purposes.

FIELD OF THE INVENTION

The present invention relates to a toy gun, and in particular a reconfigurable toy gun that projects a soft dart or other similar projectile.

BACKGROUND OF THE INVENTION

Various toy guns that operate to launch a dart or other similar projectile are known. Typically, the darts or projectiles launched by such toy guns are relatively soft and formed of a light weight material such as foam plastic or the like. The projectile weight, shape, and hardness is generally controlled by safety concerns imposed upon and undertaken by toy manufacturers. Some such toy guns launch their projectiles using a compressed air force applied to the rear of the projectile, or alternatively utilize a mechanical launcher configuration.

SUMMARY OF THE INVENTION

A toy gun according to one embodiment of the present invention utilizes a spring driven plunger mechanism which is drawn rearwardly, compressing a power spring until a trigger latch engages the plunger and inhibits its return to its forward position. A foam dart is supported within the gun barrel which is in communication with the plunger mechanism. When the trigger latch is released by pulling the trigger, the spring force operative upon the plunger drives it forwardly, compressing the air within the plunger mechanism against the rear portion of the foam dart and propelling it outwardly.

According to one embodiment, the gun handle is supported within a rotatable housing such that the upper portion of the gun is rotatable between a conventional pistol configuration and an alternative position beneath the gun handle assembly. With the upper portion of the pistol rotated downwardly, the toy weapon assumes a brass knuckle-type configuration. In one implementation, a second trigger latch mechanism is operative to releasably secure the rotated portion of the gun housing in either the pistol or brass knuckle configuration.

The present invention also relates to a reconfigurable toy gun including a handle portion, a guide member coupled to the handle portion, and a barrel portion. The guide member includes a first end portion and an opposite second end portion. The barrel portion is slidably coupled to the guide member, and movable along the guide member between the first and second end portions thereof.

In one embodiment, the handle portion includes an upper end portion and an opposite lower end portion. The first end portion of the guide member is coupled to the upper end portion of the handle. In one implementation, the guide member has a generally arcuate configuration and extends between the upper end portion and the lower end portion of the handle portion.

In one embodiment, the barrel portion includes a receptacle configured for receiving a projectile and a launcher mechanism in communication with the receptacle. The launcher mechanism is configured to expel the projectile from the receptacle upon actuation. In one implementation, the launcher mechanism includes a plunger movable toward and away from the receptacle. The plunger is moved toward the receptacle upon actuation of the launcher mechanism so that a burst of air is generated and forced outwardly from the receptacle, thereby expelling the projectile disposed within the receptacle.

In one embodiment, the barrel portion is releasably retained in a selected position along the guide member via a latch mechanism. The latch mechanism is actuatable by a user by activating a release trigger operably associated with the latch mechanism.

The present invention also relates to a toy projectile launcher including a barrel portion and a launcher mechanism. The barrel portion defines an opening and a receptacle in communication with the opening. The receptacle is configured for receiving a compatible projectile. The receptacle includes an aperture spaced from the opening and blocked by the compatible projectile when the compatible projectile is received in the receptacle. The launcher mechanism is in communication with the receptacle, and includes a plunger movable toward and away from the receptacle. The plunger is moved toward the receptacle upon activation of the launcher mechanism so that a burst of air is generated and forced through the receptacle. The burst of air is forced against the compatible projectile received within the receptacle so that the compatible projectile is expelled from the opening of the barrel portion. The burst of air is forced out the aperture when a non-compatible projectile having a configuration insufficient to block the aperture is disposed within the receptacle so that the non-compatible projectile remains in the receptacle.

In one embodiment, the barrel portion includes a valve pivotally coupled to a sidewall defining the receptacle. The valve is movable between a closed position blocking the aperture and an open position allowing access to the aperture. The compatible projectile engages the valve and moves the valve to the closed position when the compatible projectile is received in the receptacle.

In one embodiment, the projectile launcher includes a handle portion having a guide member. The barrel portion is coupled to and slidably movable along the guide member. In one implementation, the guide member has an arcuate configuration having a first end coupled to an upper portion of the handle portion and a second end coupled to a lower portion of the handle portion. The barrel portion is movable along the guide member between the first and second ends thereof.

In one embodiment, the launcher mechanism includes a compression chamber in communication with the receptacle. The plunger is movably disposed within the compression chamber.

The present invention also relates to a reconfigurable toy gun including a handle portion having an upper portion and a lower portion and a barrel portion slidably coupled to the handle portion. The barrel portion is movable between a first position proximate the upper portion and a second position proximate the lower portion.

In one embodiment, the toy gun further includes an arcuate guide member having a first end coupled to the upper portion of the handle portion and an opposite second end coupled to the lower portion of the handle portion. The barrel portion is slidably movable along the guide member between the first and second ends thereof. In one implementation, the arcuate guide member includes a track. The barrel portion includes roller members slidably coupled to and movable along the track.

In one embodiment, in the first position the barrel portion extends outwardly from the upper portion of the handle portion in a first direction. In the second position the barrel portion extends outwardly from the lower portion of the handle portion in a second direction different than the first direction. In one implementation, the first direction is substantially opposite the second direction.

In one embodiment, the barrel portion includes a storage receptacle configured for storing at least one projectile.

BRIEF DESCRIPTION OF THE DRAWINGS

The present invention is shown in the various figures attached hereto in which each element maintains the same reference numeral in the various views shown herein and in which.

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

By way of overview, a toy dart gun according to an embodiment of the present invention provides a spring-driven, pneumatically operated foam dart projectile gun, which is shaped and configured to be held and operated as a hand gun or pistol. A mechanism is provided for cocking the gun and launching a foam dart projectile in response to a trigger pull. In accordance with one embodiment, the pistol housing and handle of the toy gun are configured to be separable at the upper end of the pistol handle. The upper portion of the pistol is rotatable between a conventional position above the handle and a secondary position beneath the handle providing a brass knuckle-type weapon.

Figure 1:
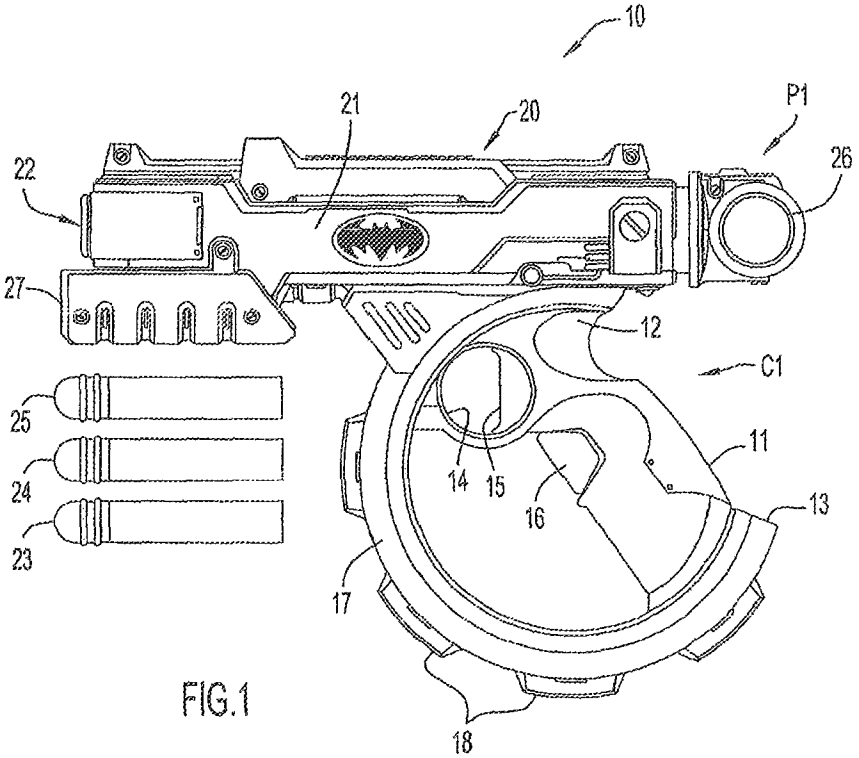
FIG. 1 illustrates a partially sectioned side elevation view of a toy dart gun constructed in accordance with one embodiment of the present invention in its pistol configuration.

FIG. 1 sets forth a side elevation view of a toy dart gun 10 in a pistol configuration C1. FIG. 1 also shows gun 10 in a relaxed or un-cocked position P1.

More specifically, gun 10 includes a handle 11 having an upper handle portion 12 and a lower handle portion 13. Handle 11 further includes a trigger finger aperture 14 within which a trigger 15 is movably supported. Handle 11 further supports a release button 16. Toy gun 10 further includes an arcuate guide 17 upon which a plurality of knuckle studs, such as studs 18, are formed and extend outwardly from guide 17.

Gun 10 further includes a dart launcher 20 having a dart barrel 21 and a dart receptacle 22 formed therein. A plunger handle 26 is moveably supported by a plunger mechanism within dart launcher 20. Barrel 21 further supports dart storage receptacles 27, 28.

Figure 2:
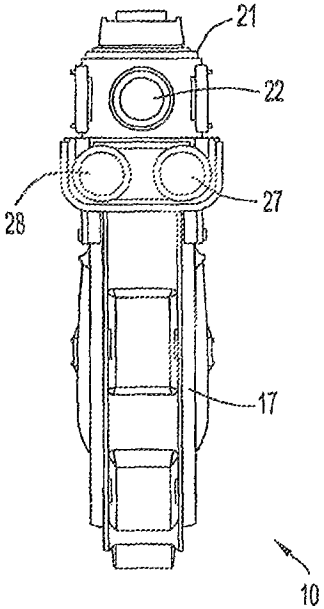
FIG. 2 illustrates a front view of the toy dart gun of FIG. 1.
Figure 5:
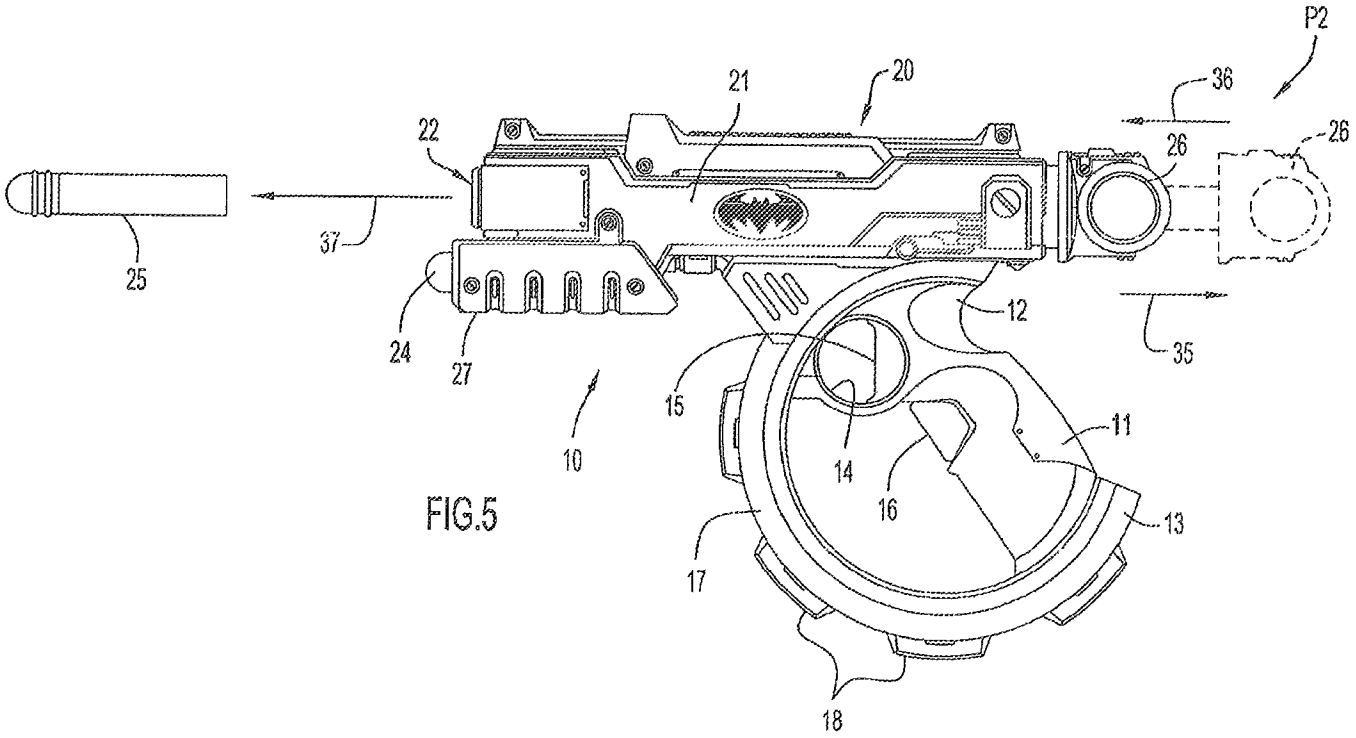
FIG. 5 illustrates a side elevation view of the toy dart gun of FIG. 1 showing the gun cocking and projectile operations.

Referring to FIGS. 1 and 2, a plurality of foam darts 23, 24 and 25 are provided. Each of foam darts 23, 24, 25 is receivable within dart receptacle 22 for launching and within dart storage receptacles 27, 28 when not in use. In the position shown in FIG. 1, dart launcher 20 is in its raised position, or pistol configuration C1, upon handle 11 such that the upper handle portion 12 engages and locks dart launcher 20 in place. In this position, the dart launching function of toy dart gun 10 may be carried forward in the manner described in further detail below and as shown in FIG. 5.

FIG. 2 sets forth a front view of toy gun 10 showing dart storage receptacles 27, 28 positioned beneath dart receptacle 22, all of which are supported by barrel 21.

Figure 3:
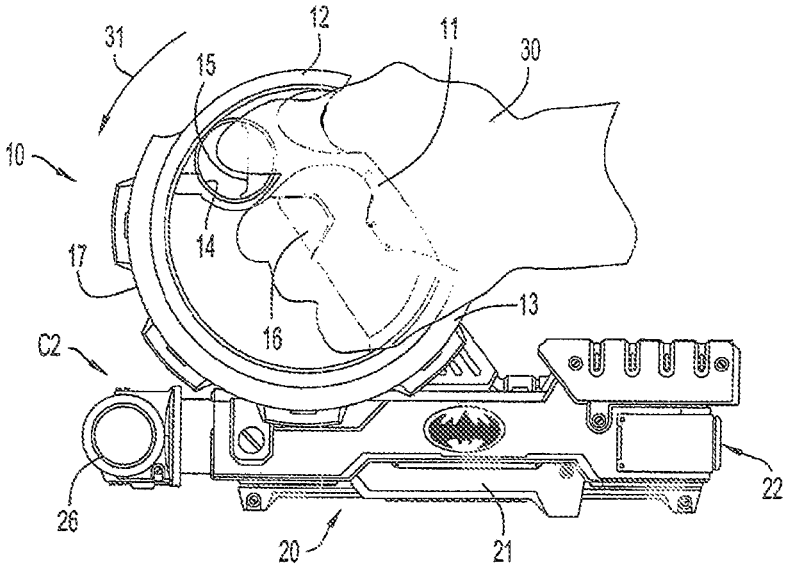
FIG. 3 illustrates a side elevation view of the toy dart gun of FIG. 1 being held in its brass knuckle configuration.

FIG. 3 sets forth a side elevation view of toy dart gun 10 configured in a lowered position, or "brass knuckle" configuration C2, upon handle 11, while being held by a user's hand 30. The objective of the configuration of FIG. 3 is to provide a simulated brass knuckle-type toy weapon for fanciful play. In this configuration, the dart launcher 20 is pivoted downwardly in the direction indicated by arrow 31 and is latched in its lowered position.

With dart launcher 20 pivoted downwardly in the direction indicated by arrow 31, an internal latch mechanism is operative between lower handle 13 and dart launcher 20 to retain dart gun 10 in its brass knuckle configuration C2. In accordance with the present invention, the user is able to release the latch retaining toy dart gun 10 in its brass knuckle configuration C2 by actuating (e.g. depressing) release 16. Thereafter, the user continues to hold handle 11 and with a rapid hand movement in the upward direction causes dart launcher 20 to rotate upwardly in the manner shown in FIG. 4.

Figure 4:
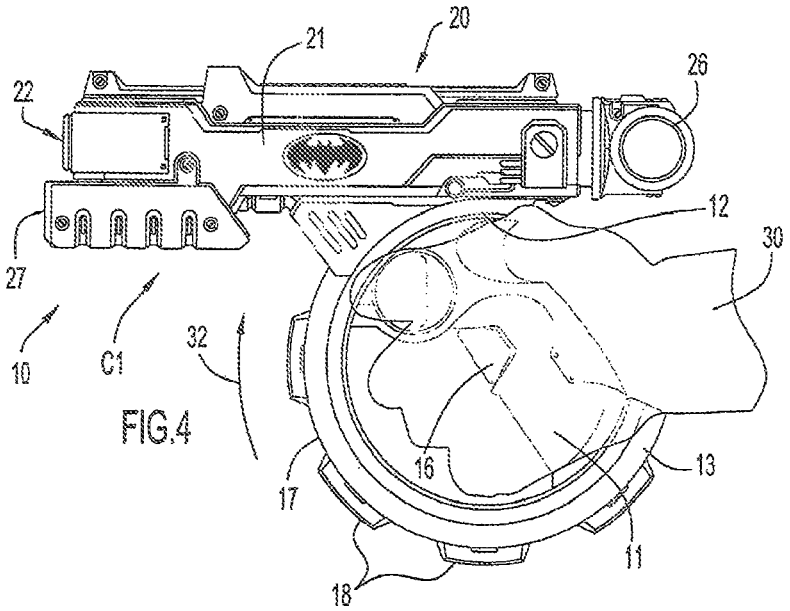
FIG. 4 illustrates a side elevation view of the toy dart gun of FIG. 1 being held in its pistol configuration.

FIG. 4 shows a side elevation view of toy dart gun 10 being held by a user while the toy dart gun is returned to its pistol configuration C1.

A comparison of FIGS. 3 and 4 shows that toy gun 10 has been returned to its pistol configuration C1 by the upward rotation of dart launcher 20 in the manner indicated by arrow 32. This rotation is carried forward while the user continues to grip handle 11 with hand 30. In an exemplary mode of operation, the movement required to return toy gun 10 to its pistol configuration is obtained by a rapid movement upwardly of hand 30 followed by a rapid cessation of movement which causes dart launcher 20 to reach the pistol configuration C1 shown in FIG. 4. Once dart launcher 20 has moved to the position shown in FIG. 4, an internal releasable latch mechanism is operative to releasably secure toy dart gun 10 in the configuration of FIG. 4.

FIG. 5 sets forth a side elevation view of toy dart gun 10 in a shooting operation. The depiction in FIG. 5 shows the cocking action of the plunger mechanism, showing the plunger handle 26 in a cocked position P2 in phantom as well as the launch of a foam dart 25 from the dart receptacle 22.

In the configuration shown in FIG. 5, toy dart gun 10 may be maintained in its pistol configuration C1 and a foam dart 25 is inserted into dart receptacle 22. Additionally, toy foam dart 24 is stored within storage receptacle 27. With dart 25 inserted into receptacle 22, the firing sequence of toy dart gun 10 may be initiated by the movement of plunger handle 26 away from launcher 20 in the direction indicated by arrow 35. This rearward draw of plunger handle 26 is continued until it reaches the position shown in phantom line depiction. At this point, the trigger launcher mechanism is operative to secure an internal plunger in the cocked position against the force of the spring plunger. Embodiments of a launcher mechanism including an internal plunger and power spring are described in further detail below. Finally, the user presses trigger 15, thereby releasing the trigger latch which thus far has restrained the internal plunger mechanism of toy dart gun 10, which in turn operates in a conventional manner to produce air pressure within dart receptacle 22. The dart 25 is thus caused to be expelled from receptacle 22 in the direction indicated by arrow 37. Thus, toy dart gun 10 is operative in a repeated fashion by inserting a foam dart into dart receptacle 22 and thereafter drawing plunger handle 26 rearwardly in the direction of arrow 35. Thereafter, pressing trigger 15 releases the plunger mechanism and moves plunger handle 26 in the direction indicated by arrow 36 and expels the foam dart from the receptacle 22.

Thus, the toy dart gun 10 is operable in a conventional pistol-like configuration C1. Additionally, the toy dart gun 10 is reconfigurable to form a brass knuckle-type toy simulated weapon in configuration C2.

Figure 6:
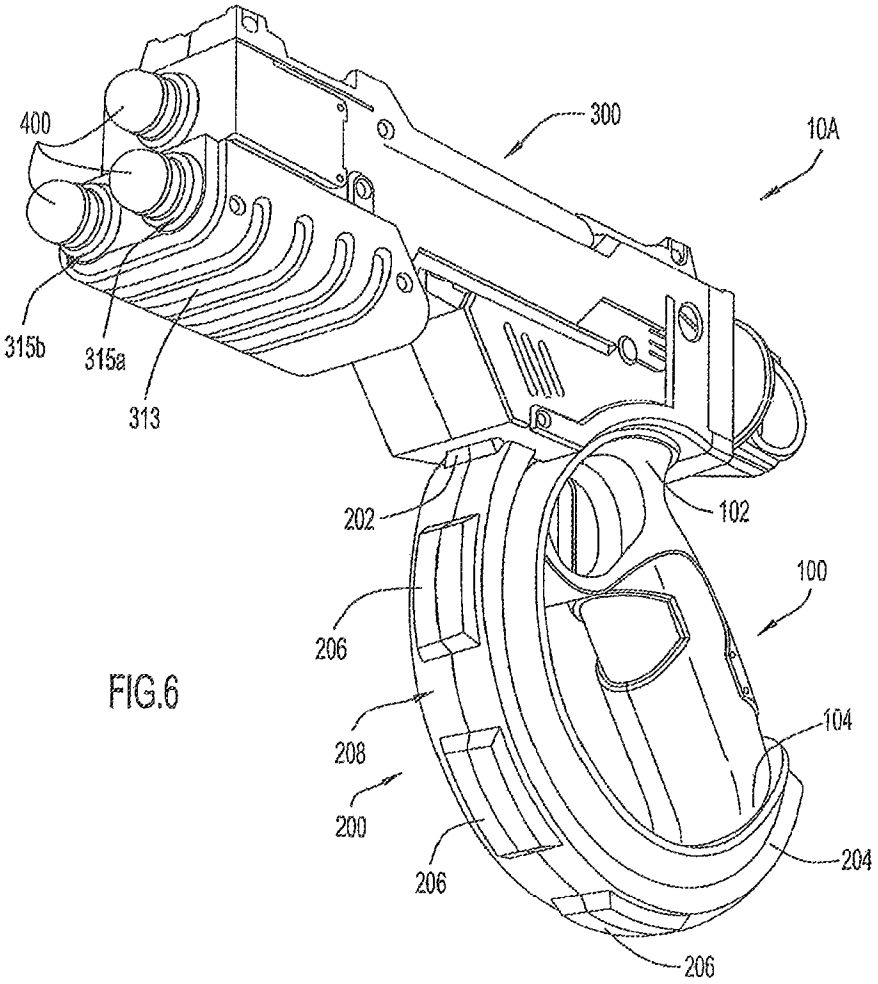
FIG. 6 illustrates a perspective view of a reconfigurable toy gun according to another embodiment of the present invention.

FIG. 6 illustrates a perspective view of a reconfigurable toy gun 10A according to another embodiment of the present invention. Gun 10A includes a handle portion 100, a guide member 200 coupled to the handle portion 100, and a barrel portion 300 slidably coupled to the guide member 200. The guide member 200 includes an end portion 202 and an opposite end portion 204. The barrel portion 300 is movable along the guide member 200 between the opposing end portions 202, 204 thereof.

In one embodiment, the handle portion 100 includes an upper end portion 102 and an opposite lower end portion 104. The end portion 202 of the guide member 200 is coupled to the upper end portion 102 of the handle portion 100. The opposite end portion 204 of the guide member 200 is coupled to the lower end portion 104 of the handle portion 100. Thus, the guide member 200 extends between the upper end portion 102 and the lower end portion 104 of the handle portion 100. In one implementation, the guide member 200 has a generally arcuate configuration. The guide member 200 may include studs 206 extending outwardly from an exterior side 208 thereof.

Figure 7:
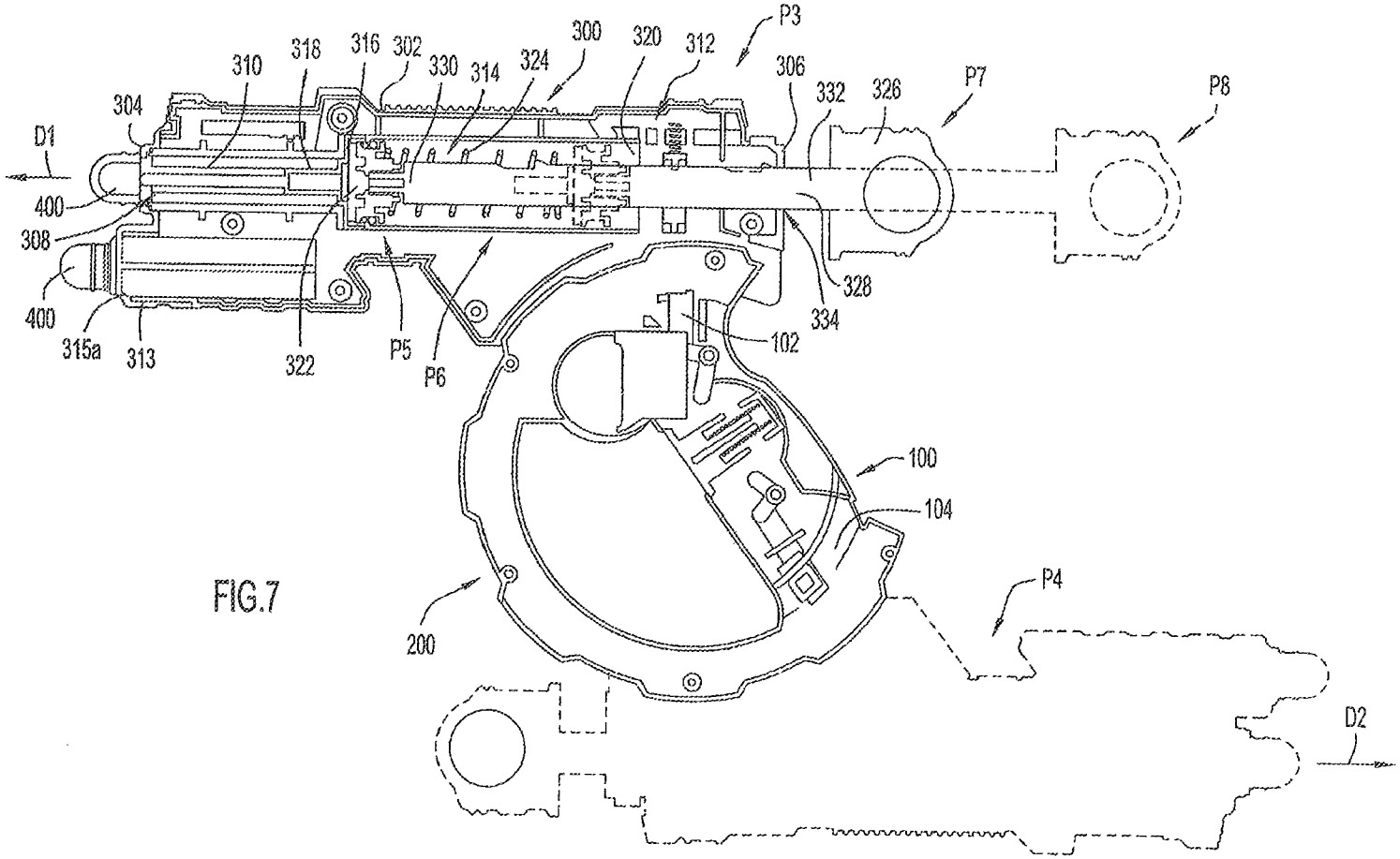
FIG. 7 illustrates a sectional elevational side view of the toy gun of FIG. 6 showing alternative positions of components in phantom.

Referring to FIG. 7, the barrel portion 300 is movable along the guide member 200 between a position P3 proximate the upper end portion 102 of the handle portion 100, and a position P4 (shown in phantom) proximate the lower end portion 104 of the handle portion 100. The barrel portion 300 extends outwardly from the handle portion 100 in a first direction D1 when the barrel portion 300 is in its position P3. The barrel portion 300 extends outwardly from the handle portion 100 in a second direction D2 when the barrel portion 300 is in its position P4. In one implementation, the first direction D1 is substantially opposite the second direction D2.

The barrel portion 300 includes a central body 302 having an end wall 304 and an opposite end wall 306. An opening 308 is disposed in the end wall 304. The opening 308 is in communication with a receptacle 310 defined by the central body 302. The receptacle 310 is configured for receiving a projectile 400 that is inserted through the opening 308. A launcher mechanism 312 is in communication with the receptacle 310. The launcher mechanism 312 is configured for expelling the projectile 400 from the receptacle 310 upon actuation.

In one embodiment, the barrel portion 300 includes a storage receptacle 313 having compartments 315*a*, 315*b* (shown in FIG. 6) configured for storing additional projectiles 400. After launching one of the projectiles 400 from the receptacle 310, a user may remove another projectile 400 from one of the compartments 315*a* or 315*b* and "re-load" the toy gun 10A by inserting the next projectile 400 into the receptacle 310.

In one embodiment, the launcher mechanism 312 includes a compression chamber 314 having an end portion 316 in communication with an end 318 of the receptacle 310, and an opposite end portion 320. A plunger 322 is disposed within the compression chamber 314 and movable between a position P5 proximate the end portion 316 of the compression chamber 314 and proximate the end 318 of the receptacle 310, and another position P6 (shown in phantom) spaced from the end portion 316 of the compression chamber 314 and proximate the opposite end portion 320 thereof. Thus, the plunger 322 is movable toward and away from the receptacle 310 between position P5 and position P6. The plunger 322 is biased toward its position P5 proximate the end portion 316 of the compression chamber 314 via a resilient member, such as a compression spring 324.

With continued reference to FIG. 7, the launcher mechanism 312 further includes a plunger handle 326 coupled to the plunger 322 via a plunger shaft 328. In one embodiment, the plunger shaft 328 includes an end 330 coupled to the plunger 322 and an opposite end 332 extending through and outwardly from an opening 334 provided in the end wall 306 of the barrel portion 300. The plunger handle 326 is coupled to the end 332 of the plunger shaft 328, and is disposed outwardly from the end wall 306 of the barrel portion 300. The plunger 322 is moved from its position P5 proximate the receptacle 310 to its position P6 spaced from the receptacle 310 by pulling the plunger handle 326 outwardly and away from the end wall 306 of the barrel portion 300. Thus, the plunger handle 326 is movable between a position P7 proximate to the end wall 306 and another position P8 (shown in phantom) spaced further from the end wall 306.

In order to actuate the launcher mechanism 312, the plunger handle 326 is pulled outwardly from the end wall 306 to its position P8 spaced from the end wall 306. Accordingly, the plunger 322 is moved to its corresponding position P6 spaced from the receptacle 310. The compression spring 324 is thereby compressed between the plunger 322 and the end portion 320 of the compression chamber 314.

Upon actuation of the launcher mechanism 312, the plunger 322 is rapidly moved toward the receptacle 310 via decompression of the spring 324, from its position P6 back to its position P5. As a result, air within the compression chamber 314 is compressed and forced into the receptacle 310 through end 318. The burst of air that is generated by the plunger 322 is forced against the projectile 400 disposed within the receptacle 310, so that the projectile 400 is expelled from the receptacle 310 and fired out of the opening 308 in the end 304 of the barrel portion 300.

Figure 8:
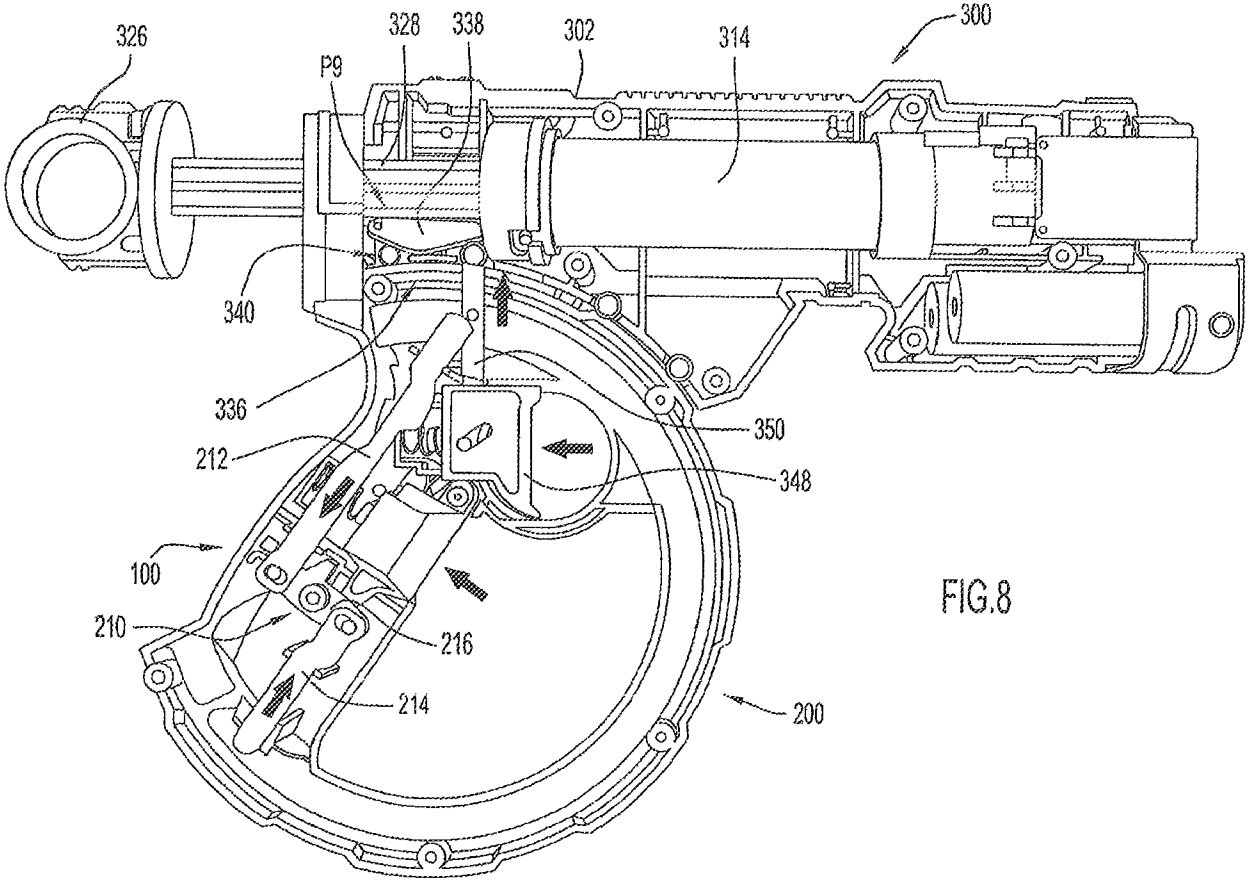
FIG. 8 illustrates another sectional perspective view of the toy gun of FIG. 6.
Figure 9:
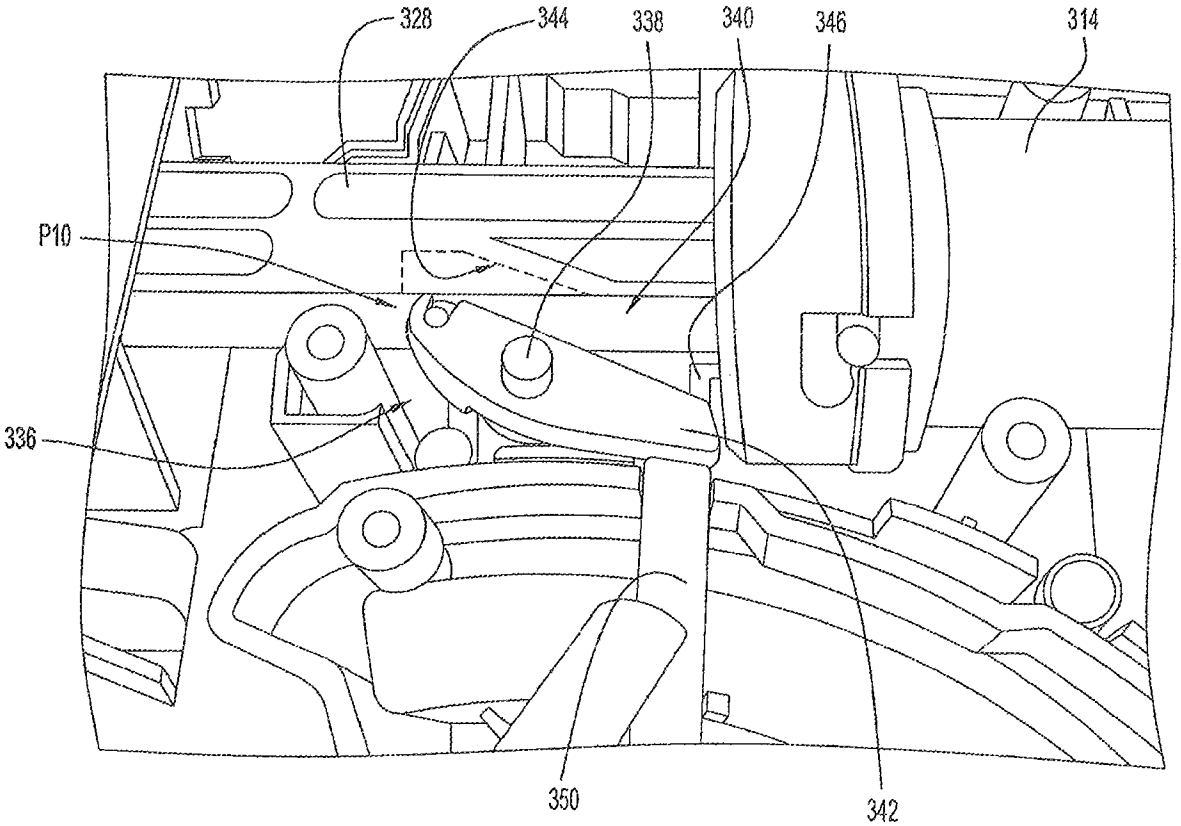
FIG. 9 illustrates an exploded perspective view of components shown in FIG. 8.

Referring to FIGS. 7, 8 and 9, in one embodiment the plunger 322 is releasably retained in its position P6 spaced from the receptacle 310, and the plunger handle 326 releasably retained in its corresponding position P8 spaced from the end wall 306 via a latch mechanism 336. As shown in FIGS. 8 and 9, the latch mechanism 336 includes a pivot bar 338 disposed within a cavity 340 defined by the central body 302 of the barrel portion 300 and adjacent the plunger shaft 328. An end 342 of the pivot bar 338 is pivotally movable between a raised position P9 (shown in FIG. 8) and a lowered position P10 (shown in FIG. 9). The pivot bar 338 moves from its raised position P9 to its lowered position P10 when the plunger shaft 328 slides outwardly. In one embodiment, the plunger shaft 328 includes a cam surface or recess 344 (shown in phantom) that engages the pivot bar 338 when the plunger shaft 328 is slid outwardly, such as when the plunger handle 326 is in position P8 and spaced from the end wall 306. As a result, the pivot bar 338 is moved downwardly to its lowered position P10, and retained in its lowered position P10 via a catch 346. When the pivot bar 338 is disposed in its lowered position P10, movement of the plunger shaft 328 is restricted via the engagement between the end 342 of the pivot bar 338 and the catch 346. Thus, the plunger shaft 328 and plunger 322 within the compression chamber 314 are retained in a cocked position (e.g. the plunger 322 is releasably retained in its position P6).

As shown in FIG. 8, a trigger 348 is coupled to a link 350. Upon activation of the trigger 348, the link 350 is moved upwardly and into engagement with the pivot bar 338. The pivot bar 338 is pushed upwardly by the link 350 and away from the catch 346. As a result, the pivot bar 338 is released from its lowered position P10. The plunger shaft 328 is thereby permitted to slide inwardly within the central body 302 of the barrel portion 300, so that the plunger 322 is moved rapidly back (via the spring) toward the receptacle 310, as described above.

Figure 10:
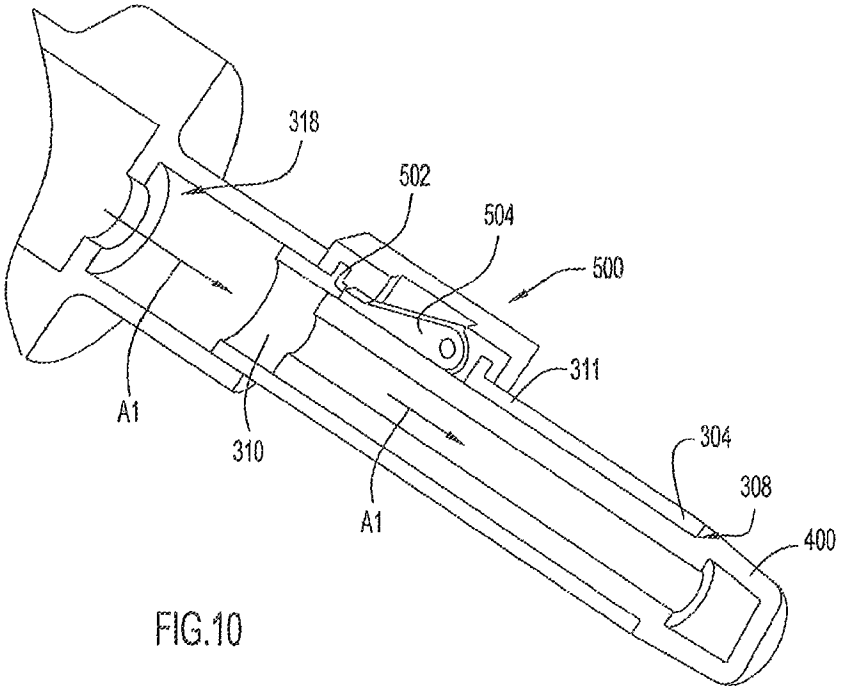
FIG. 10 illustrates a fragmentary perspective view of a receptacle a toy gun according to an embodiment of the present invention and showing a compatible projectile disposed in the receptacle.
Figure 11:
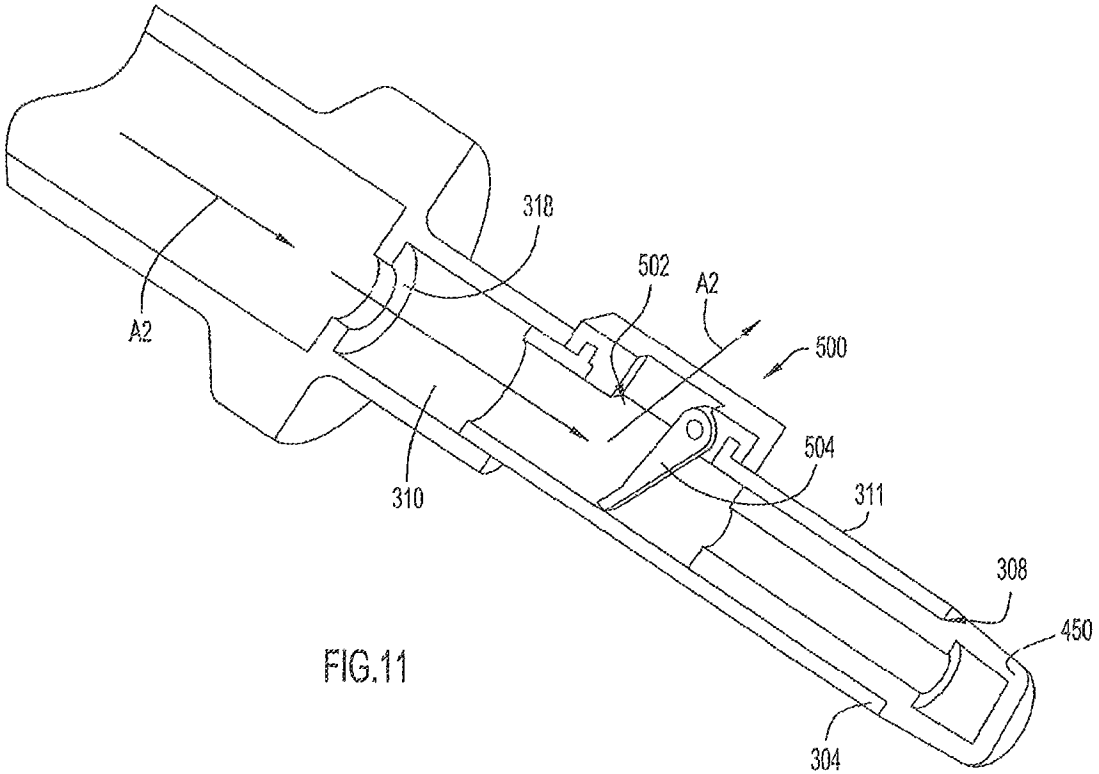
FIG. 11 illustrates a fragmentary perspective view of the receptacle of FIG. 10 and showing a non-compatible projectile disposed in the receptacle.

Referring to FIGS. 10 and 11, in one embodiment the receptacle 310 includes a safety mechanism 500 that prevents a non-compatible projectile from being fired by the toy gun 10A. In one implementation, the safety mechanism 500 includes an aperture 502 disposed in a sidewall 311 of the receptacle 310. The aperture 502 is located in between the opening 308 in the end wall 304 of the barrel portion 300 and the end 318 of the receptacle 310. The receptacle 310 is configured for receiving a compatible projectile, such as projectile 400, which blocks the aperture 502 when the projectile 400 is properly seated within the receptacle 310, as shown in FIG. 10. Thus, as the plunger 322 moves from its position P6 to its position P5 and generates a burst of air, the resulting air flow Al is forced into the receptacle 310 through its end 318 and expels the compatible projectile 400 from the receptacle 310, as described above.

As shown in FIG. 11, if a non-compatible projectile disposed within the receptacle 310, such as a projectile 450 having a configuration and/or length insufficient to block the aperture 502 when disposed within the receptacle 310, the resulting air flow A2 generated by the plunger 322 is forced out the aperture 502. As a result, the non-compatible projectile 450 remains in the receptacle 310.

In one embodiment, a valve 504 is pivotally coupled to the sidewall 311 of the receptacle 310 proximate the aperture 502. The valve 504 is pivotally movable between a closed position (shown in FIG. 10) blocking the aperture 502 and an open position (shown in FIG. 11) allowing access to the aperture 502. The valve 504 is biased toward its open position, such as by a spring or other resilient member. The compatible projectile 400 engages the valve 504 when properly and fully inserted within the receptacle 310, so that the valve 504 is pushed to its closed position. Thus, the valve 504 ensures that a relatively tight air seal is provided within the receptacle 310 when the compatible projectile 400 is received therein. In addition, the valve 504 blocks the passage of air through the receptacle 310 toward the opening 308 in the end wall 304 when the valve is disposed in its open position. In this way, the air flow A2 is blocked from pushing against a non-compatible projectile 450 and instead redirected out the aperture 504.

Figure 12:
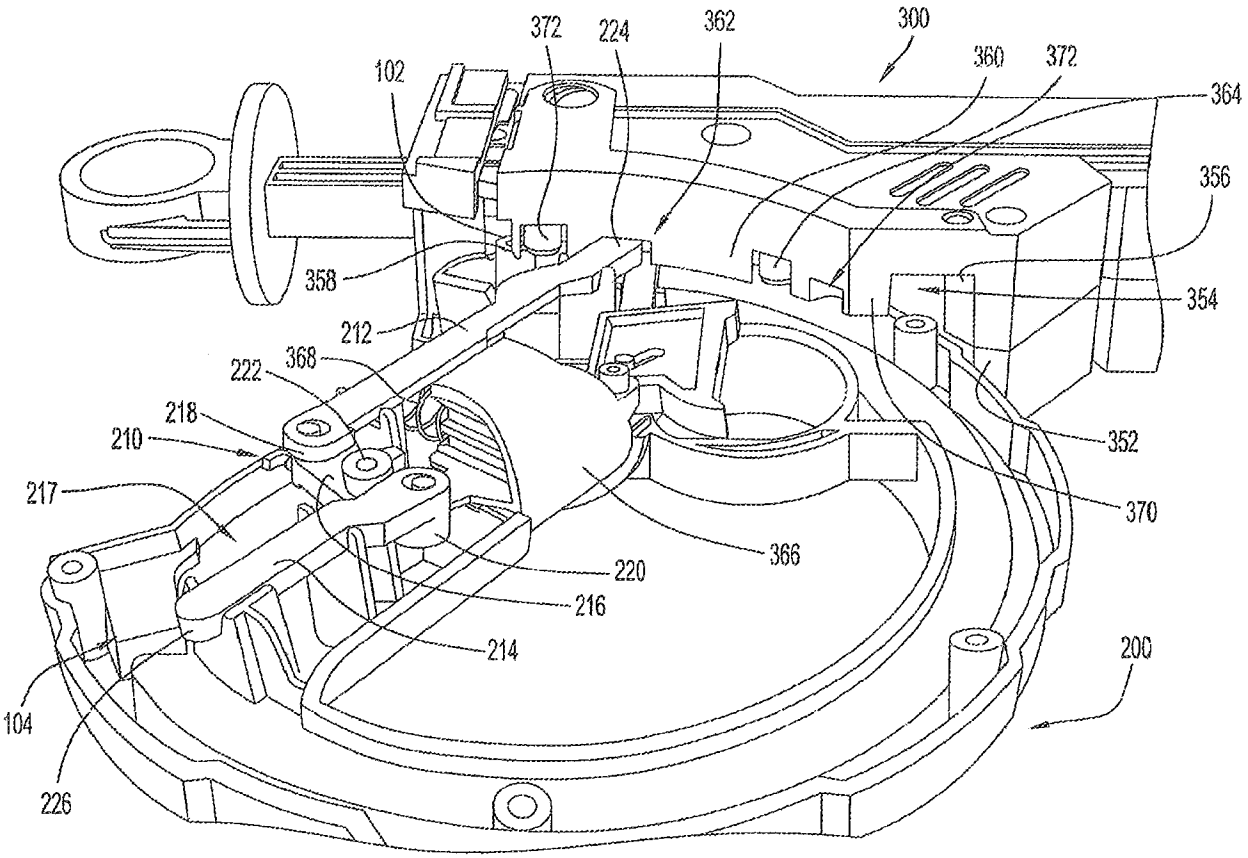
FIG. 12 illustrates a fragmentary sectional perspective view of components of the toy gun of FIG. 6.

Referring to FIGS. 8 and 12, in one embodiment the barrel portion 300 is releasably retained in a selected position along the guide member 200 via a latch mechanism 210. The latch mechanism 210 includes an upper link 212, a lower link 214, and a cross link 216 disposed within a cavity 217 defined by the handle portion 100. The cross link 216 includes an end 218 pivotally coupled to the upper link 212, and an opposite end 220 pivotally coupled to the lower link 214. The cross link 216 is pivotally disposed within the cavity 217, and movable about a central pivot point 222. As the cross link 216 pivots about its central pivot point 222, a distal end 224 of the upper link 212 moves toward or away from the upper end portion 102 of the handle portion 100 (depending on the direction of pivotal movement). At the same time, as the cross link 216 pivots about its central pivot point 222, a distal end 226 of the lower link 214 moves toward or away from the lower end portion 104 of the handle portion 100 (depending on the direction of pivotal movement).

Referring to FIG. 12, an underside 352 of the central body 302 of the barrel portion 300 includes a channel 354 having opposing openings 356, 358. An outer wall 360 defines a portion of the channel 354. The distal end 224 of the upper link 212 is receivable in a correspondingly configured opening 362 defined by the outer wall 360 when the barrel portion 300 is in its position P3 (shown in FIG. 7) proximate the upper end portion 102 of the handle portion 100. The distal end 226 of the lower link 214 is receivable in another correspondingly configured opening 364 defined by the outer wall 360 when the barrel portion 300 is in its position P4 (shown in FIG. 7) proximate the lower end portion 104 of the handle portion 100.

When the distal end 224 is disposed within the opening 362, movement of the barrel portion 300 along the guide member 200 and relative to the handle portion 100 is restricted. Similarly, when the distal end 226 is disposed within its corresponding opening 364, movement of the barrel portion 300 along the guide member 200 and relative to the handle portion 100 is restricted. Thus, the barrel portion 300 may be releasably retained in either its position P3 or its position P4.

A user may release the barrel portion 300 from either position P3 or position P4 by actuating a release trigger 366 operatively coupled to the cross link 216. If the barrel portion 300 is disposed in its position P3, depression of the release trigger 366 causes pivotal movement of the cross link 216, so that the distal end 224 of the upper link 212 is retracted from within the opening 362 and moves away from the upper end portion 102 of the handle 100. Simultaneously, the distal end 226 of the lower link 214 moves away from the lower end portion 104 of the handle portion 100. If the barrel portion 300 is disposed in its position P4, the distal end 226 is retracted from the opening 364. Thus, the barrel portion 300 is permitted to slide along the guide member 200 upon depression of the release trigger 366.

In one embodiment, the upper link 212 and the lower link 214 are biased outwardly toward their locked positions via a resilient member (not shown). The release trigger 366 is biased outwardly in a non-actuated position via another resilient member, such as spring 368. The barrel portion 300 may be retained in its locked position (e.g. position P3 or position P4) until a user actuates the release trigger 366.

If the barrel portion 300 is disposed in a position intermediate position P3 and position P4 and the release trigger 366 is not being actuated, the upper link 212 and the lower link 214 are biased toward their outwardly extended positions via the associated resilient member(s). If the upper link 212 is contacting the outer wall 360 of the central body 302, the barrel portion 300 may slide along the guide member 200 until the distal end 224 of the upper link 212 drops into place within its corresponding opening 362 in the outer wall 360 (or alternatively it may be slid downwardly toward position P4). Similarly, if the lower link 214 is contacting the outer wall 360, the barrel portion 300 may slide along the guide member 200 until the distal end 226 of the lower link 214 drops into place within its corresponding opening 364 in the outer wall 360 (or alternatively may be slid upwardly toward position P3).

If neither the upper link 212 nor the lower link 214 is contacting the outer wall 360 (e.g. such as when the barrel portion 300 is in a position intermediate the end portions 202, 204 of the guide member 200), the barrel portion 300 may proceed to move along the guide member 200 until one of the distal ends 224, 226 of the upper and lower links 212, 214, respectively, are contacted by a corresponding cam surface 370 disposed on opposing ends of the outer wall 360. Each cam surface 370 has a sloped configuration. The distal ends 224, 226 engage the corresponding cam surfaces 370 and travel upwardly along the cam surface 370 toward the outer wall 360. As a result, the distal ends 224, 226 are pushed inwardly against the biasing force of their corresponding resilient member. The distal end 224 or 226 then travels along the outer wall 360 until it reaches its corresponding opening 362, 364, and again releasably locks the barrel portion 300 in position P3 or position P4.

Figure 13:
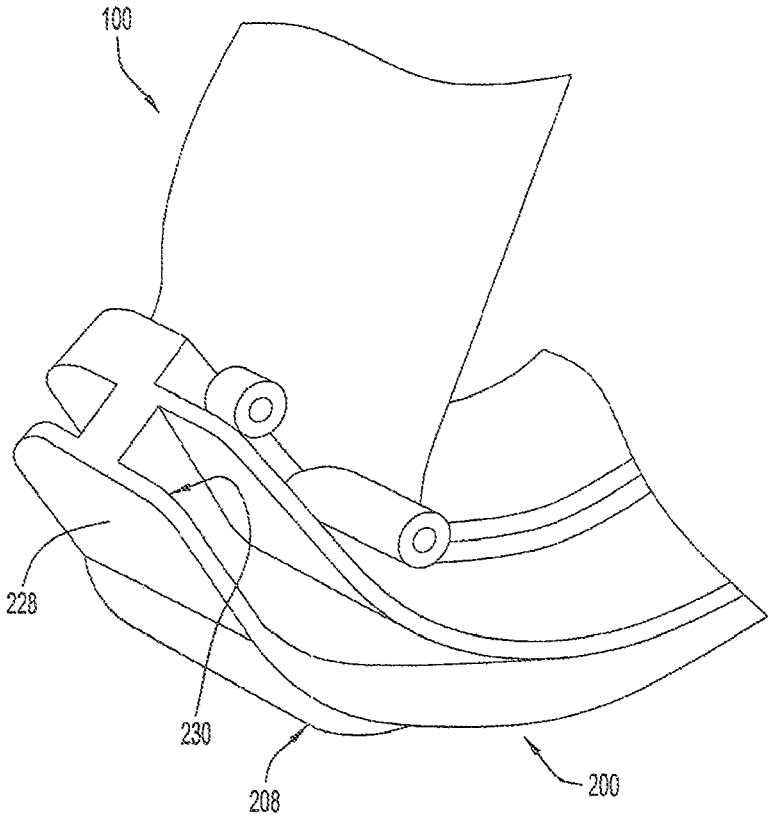
FIG. 13 illustrates an exploded fragmentary view of a portion of a guide member and a handle portion of the toy gun of FIG. 6.

Referring to FIGS. 12 and 13, in one embodiment the guide member 200 includes a track 228 extending outwardly from or defined by the exterior side 208 thereof. The track 228 is disposed within the channel 354. In one embodiment, the central body 302 is formed from two halve sections coupled together, so that the track 228 is sandwiched between the two halve sections.

The track 228 is movable within the channel 354, so that the barrel portion 300 is slidable along the track 228. In one embodiment, the barrel portion 300 includes several roller assemblies 372 adjacent the channel 354. In one embodiment, the roller assemblies 372 have a generally cylindrical configuration and rotate about their longitudinal axis. The roller assemblies 372 rotatably engage and/or roll along an inner surface 230 of the track 228, thereby enhancing the sliding movement of the barrel portion 300 along the guide member 200 and reducing friction therebetween.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A toy projectile launcher, comprising:

a barrel defining a receptacle configured to receive a compatible projectile, the barrel comprising:

a first end, a second end opposite the first end, an opening disposed in the first end, an aperture disposed on the barrel between the first end and the second end, and a valve pivotally attached to the barrel proximate to the aperture, the valve having an open position and a closed position, the valve being oriented in the closed position when a compatible projectile is disposed within the receptacle;

a launcher mechanism coupled to the second end of the barrel and configured to generate a burst of air into the receptacle; and a handle coupled to the launcher mechanism, the handle including an actuator configured to actuate the launcher mechanism.

2. The toy projectile launcher of claim 1, wherein the launcher mechanism includes a plunger movable toward and away from the receptacle, and the plunger is moved toward the receptacle upon activation of the launcher mechanism generating the burst of air.

3. The toy projectile launcher of claim 2, wherein the launcher mechanism includes a compression chamber in communication with the receptacle, and the plunger is movably disposed within the compression chamber.

4. The toy projectile launcher of claim 1, wherein the burst of air is forced out the aperture when a non-compatible projectile is disposed within the receptacle so that the non-compatible projectile remains in the receptacle.

5. The toy projectile launcher of claim 1, wherein the valve member is biased toward the open position by a spring or other resilient member.

6. A toy projectile launcher, comprising:

a barrel portion with a first end and a second end, the first end including an opening, the barrel portion defining a receptacle in communication with the opening and configured to receive a compatible projectile;

a launcher mechanism coupled to the second end of the barrel portion and in communication with the receptacle, the launcher mechanism configured to generate a burst of air that is forced through the second end of the barrel portion and into the receptacle;

an aperture disposed on the barrel portion between the first end and the second end and in communication with the receptacle;

a handle portion coupled to the launcher mechanism, the handle portion including an actuator configured to actuate the launcher mechanism; and a valve member pivotally coupled to the receptacle of the barrel portion proximate the aperture, the valve member sealing the aperture when a compatible projectile is received in the receptacle, wherein the burst of air from the launching mechanism is forced against the compatible projectile received within the receptacle so that the compatible projectile is expelled from the opening of the barrel portion, and the burst of air is forced out the aperture when an incompatible projectile having a configuration insufficient to pivot the valve member into the aperture is disposed within the receptacle so that the incompatible projectile remains in the receptacle.

7. The toy projectile launcher of claim 6, wherein the valve member is biased toward an open position.

8. The toy projectile launcher of claim 7, wherein the valve member is biased by a spring or other resilient member.

9. The toy projectile launcher of claim 6, wherein the launcher mechanism includes a compression chamber in communication with the receptacle, and a plunger that is movably disposed within the compression chamber.

10. The toy projectile launcher of claim 6, wherein the handle portion includes a guide member, the barrel portion coupled to and slidably movable along the guide member.

11. The toy projectile launcher of claim 10, wherein the guide member has an arcuate configuration having a first end coupled to an upper portion of the handle portion and a second end coupled to a lower portion of the handle portion, and the barrel portion is movable along the guide member between the first and second ends thereof.

12. A toy projectile launcher, comprising:

a barrel defining a receptacle, the barrel including a first end defining an opening, a second end, the receptacle configured to receive a compatible projectile through the opening;

a launcher mechanism disposed on the second end of the barrel and configured to generate a burst of air into the receptacle;

a handle coupled to the launcher mechanism, the handle including an actuator configured to actuate the launcher mechanism; and an aperture disposed on the barrel between the first end and the second end, the compatible projectile blocking the aperture when received by the receptacle, wherein the burst of air from the launcher mechanism is forced against the compatible projectile received within the receptacle expelling the compatible projectile from the opening of the receptacle, and the burst of air is forced out the aperture when an incompatible projectile is disposed within the receptacle so that the incompatible projectile remains in the receptacle.

13. The toy projectile launcher of claim 12, wherein the launcher mechanism includes a plunger movable toward and away from the receptacle, and the plunger moves toward the receptacle upon activation of the launcher mechanism, thereby generating the burst of air.

14. The toy projectile launcher of claim 13, wherein the launcher mechanism includes a compression chamber in communication with the receptacle, and the plunger is movably disposed within the compression chamber.

15. The toy projectile launcher of claim 12, further comprising a valve pivotally coupled to the barrel proximate the aperture and movable between a closed position blocking the aperture and an open position allowing access to the aperture, the compatible projectile engaging the valve and moving the valve to the closed position when the compatible projectile is received in the receptacle.

16. The toy projectile launcher of claim 15, wherein the valve member is biased toward the open position.

17. The toy projectile launcher of claim 16, wherein the valve member is biased by a spring or other resilient member.

18. The toy projectile launcher of claim 15, wherein the valve forms an air tight seal with the aperture when in the closed position.

19. The toy projectile launcher of claim 12, further comprising a handle having a guide member, the barrel coupled to and slidably movable along the guide member.

20. The toy projectile launcher of claim 19, wherein the guide member has an arcuate configuration having a first end coupled to an upper portion of the handle and a second end coupled to a lower portion of the handle, and the barrel is movable along the guide member between the first and second ends thereof.

* * * * *